US008690002B1

(12) United States Patent
Finell

(10) Patent No.: US 8,690,002 B1
(45) Date of Patent: Apr. 8, 2014

(54) BOWL WITH SPILL-CATCHING BODY

(75) Inventor: Rebecca M. Finell, Phoenix, AZ (US)

(73) Assignee: BKD Acquisition, Inc., Oak Brook, IL (US)

( * ) Notice: Subject to any disclaimer, the term of this patent is extended or adjusted under 35 U.S.C. 154(b) by 1295 days.

(21) Appl. No.: 11/845,708

(22) Filed: Aug. 27, 2007

(51) Int. Cl.
*A47G 19/02* (2006.01)
*A47G 19/22* (2006.01)
*B65D 25/00* (2006.01)

(52) U.S. Cl.
USPC ..... 220/574.1; 220/703; 220/731

(58) Field of Classification Search
USPC ..... 220/574, 574.1, 703, 719, 731, 506; 222/571, 566, 567, 569, 572; 426/104
See application file for complete search history.

(56) References Cited

U.S. PATENT DOCUMENTS 325,842 A * 9/1885 Knapp ..... 222/566
2,106,381 A * 1/1938 Rough ..... 222/570
3,356,266 A * 12/1967 Pinter, Jr. ..... 222/192
6,511,031 B2 * 1/2003 Lin ..... 248/346.11
6,581,541 B2 * 6/2003 Hollinger ..... 119/61.54
7,134,576 B2 * 11/2006 Gringer et al. ..... 222/143
7,360,673 B2 * 4/2008 Abrahams ..... 222/571
2007/0023463 A1 * 2/2007 MacClarence ..... 222/567
2008/0217345 A1 * 9/2008 Hansen ..... 220/703

* cited by examiner

*Primary Examiner* — Bryon Gehman
*Assistant Examiner* — Shawn M Braden
(74) *Attorney, Agent, or Firm* — Michael Best & Friedrich LLP

(57) ABSTRACT

A bowl includes an upstanding continuous sidewall having opposed upper and lower ends, opposed outer and inner surfaces extending between the opposed upper and lower ends, a bottom formed at the lower end of the continuous sidewall cooperating with the inner surface of the continuous sidewall forming a fluid impervious vessel, and a peripheral upper edge formed at the upper end of the continuous sidewall bounding an opening into the fluid impervious vessel. An up-angled, broad, spill-catching body is affixed to a length of the peripheral upper edge of the continuous sidewall, which catches and directing spills into the fluid impervious vessel.

9 Claims, 8 Drawing Sheets

BOWL WITH SPILL-CATCHING BODY

FIELD OF THE INVENTION

The present invention relates to implements used for eating food and, more particularly, to food bowls used by infants and small children in eating food.

BACKGROUND OF THE INVENTION

Infants and small children are often fed baby food, applesauce, yogurt, and the like, from a bowl positioned in front of the child on a table or tray. As the child eats from the bowl, either with the aid of a caregiver or through self-feeding such as with the use of a spoon or fork, food typically is spilled onto the table or tray around the bowl creating an undesirable mess. The spilled food is typically wiped up and wasted, which many find undesirable as wasting food is typically not a desirable outcome. Although the problem of spilled food occurring as a child is fed from a bowl is a longstanding one, little has been done to solve this problem and alleviate the undesirable outcome of wasted spilled food.

SUMMARY OF THE INVENTION

Accordingly, what is needed is a bowl suitable for use by infants and small children in eating cereal, yogurt, soup, peas, noodles, or other selected food that is easy to make and inexpensive, that incorporates a spill-catching body for catching food spills and directing spilled food back into the bowl, and that incorporates a mechanism for detachably securing the bowl to a selected surface, such as the surface of a tray or the surface of table, for preventing the bowl from tipping over spilling the food contents maintained by the bowl.

According to the principle of the invention, a bowl consists of an upstanding continuous sidewall having opposed upper and lower ends, opposed outer and inner surfaces extending between the opposed upper and lower ends, a bottom formed at the lower end of the continuous sidewall cooperating with the inner surface of the continuous sidewall forming a vessel, and a peripheral upper edge formed at the upper end of the continuous sidewall bounding an opening into the vessel. The peripheral upper edge defines opposed front and rear ends, and opposed first and second sides. A broad spill-catching body has a proximal end and an opposed distal end. The proximal end of the spill-catching body is affixed to a length of the peripheral upper edge of the continuous sidewall extending along the front end of the peripheral upper edge from proximate the first side of the peripheral upper edge of the continuous sidewall to the second side of the peripheral upper edge of the continuous sidewall. The spill-catching body up-angled relative to the peripheral upper edge and extends outboard relative to the front end of the peripheral upper edge of the continuous sidewall to the distal end of the spill-catching body from proximate the first side of the peripheral upper edge of the continuous sidewall to proximate the second side of the peripheral upper edge of the continuous sidewall. The spill-catching body defines an upwardly facing spill-catching surface between the proximal and distal ends of the spill-catching body. The spill-catching surface is up-angled relative to the peripheral upper edge and extends outboard relative to the front end of the peripheral upper edge of the continuous sidewall from proximate the first side of the peripheral upper edge of the continuous sidewall to proximate the second side of the peripheral upper edge of the continuous sidewall. The spill-catching surface receives spilled food outboard of the peripheral upper edge and conducts spilled food into the vessel through the opening. The spill-catching body is formed of flexibly resilient material, and the continuous sidewall is formed of substantially rigid material. An element of an engagement pair formed in the peripheral upper edge of the continuous sidewall from proximate the first side of the peripheral upper edge of the continuous sidewall to proximate the second side of the peripheral upper edge of the continuous sidewall is secured to a complemental element of the engagement pair formed in the proximal end of the spill-catching body. Preferably, the element of the engagement pair includes one of a tongue and groove, and the complemental element of the engagement pair includes the other of the tongue and the groove. A suction cup formed on the bottom of the bowl is used to releasably secure the bottom of the bowl to a selected surface, such as the surface of a tray, the surface of a table, or other selected surface. The spill-catching surface is concave in a vertical direction from proximate the first side of the peripheral upper edge of the continuous sidewall to the second side of the peripheral upper edge of the continuous sidewall. The opening into the vessel has a first width extending from the first side of the peripheral upper edge of the continuous sidewall to the second side of the peripheral edge of the continuous sidewall, and the spill-catching surface of the spill-catching body proximate the proximal end of the spill-catching body has a second width extending from proximate the first side of the peripheral upper edge of the continuous sidewall to the second side of the peripheral upper edge of the continuous sidewall, in which the second width is substantially equal to the first width.

According to the invention, a bowl consists of an upstanding continuous sidewall having opposed upper and lower ends, opposed outer and inner surfaces extending between the opposed upper and lower ends, a bottom formed at the lower end of the continuous sidewall cooperating with the inner surface of the continuous sidewall forming a vessel, and a peripheral upper edge formed at the upper end of the continuous sidewall bounding an opening into the vessel. The peripheral upper edge defines opposed front and rear ends, and opposed first and second sides. A recess is formed in a length of the peripheral upper edge of the continuous sidewall extending along the front end of the peripheral upper edge of the continuous sidewall from proximate the first side of the peripheral upper edge of the continuous sidewall to the second side of the peripheral upper edge of the continuous sidewall. A broad spill-catching body has opposed proximal and distal ends. The proximal end of the spill-catching body is received by and affixed to the recess extending along the length of the peripheral upper edge of the continuous sidewall extending along the front end of the peripheral upper edge from proximate the first side of the peripheral upper edge of the continuous sidewall to the proximate second side of the peripheral upper edge of the continuous sidewall. The spill-catching body is up-angled relative to the peripheral upper edge and extends outboard relative to the front end of the peripheral upper edge of the continuous sidewall to the distal end of the spill-catching body from proximate the first side of the peripheral upper edge of the continuous sidewall to proximate the second side of the peripheral upper edge of the continuous sidewall. The spill-catching body defines an upwardly facing spill-catching surface between the proximal and distal ends of the spill-catching body. The spill-catching surface is up-angled relative to the peripheral upper edge and extends outboard relative to the front end of the peripheral upper edge of the continuous sidewall from proximate the first side of the peripheral upper edge of the continuous sidewall to proximate the second side of the peripheral upper edge of the continuous sidewall. The spill-catching surface receives spilled food outboard of the peripheral upper edge of the continuous sidewall and conducts spilled food into the vessel through the opening. The spill-catching body is formed of flexibly resilient material, and the continuous sidewall is formed of substantially rigid material. An element of an engagement pair formed in the recess formed in the peripheral upper edge of the continuous sidewall from proximate the first side of the peripheral upper edge of the continuous sidewall to proximate the second side of the peripheral upper edge of the continuous sidewall is secured to a complemental element of the engagement pair formed in the proximal end of the spill-catching body. Preferably, the element of the engagement pair includes one of a tongue and groove, and the complemental element of the engagement pair includes the other of the tongue and the groove. A suction cup formed on the bottom of the bowl is used to releasably secure the bottom of the bowl to a selected surface, such as the surface of a tray, the surface of a table, or other selected surface. The spill-catching surface is concave in a vertical direction from proximate the first side of the peripheral upper edge of the continuous sidewall to the second side of the peripheral upper edge of the continuous sidewall. The opening into the vessel has a first width extending from the first side of the peripheral upper edge of the continuous sidewall to the second side of the peripheral edge of the continuous sidewall, and the spill-catching surface of the spill-catching body proximate the proximal end of the spill-catching body has a second width extending from proximate the first side of the peripheral upper edge of the continuous sidewall to the second side of the peripheral upper edge of the continuous sidewall, in which the second width is substantially equal to the second width.

BRIEF DESCRIPTION OF THE DRAWINGS

Referring to the drawings.

DETAILED DESCRIPTION OF THE PREFERRED EMBODIMENT

Figure 1:
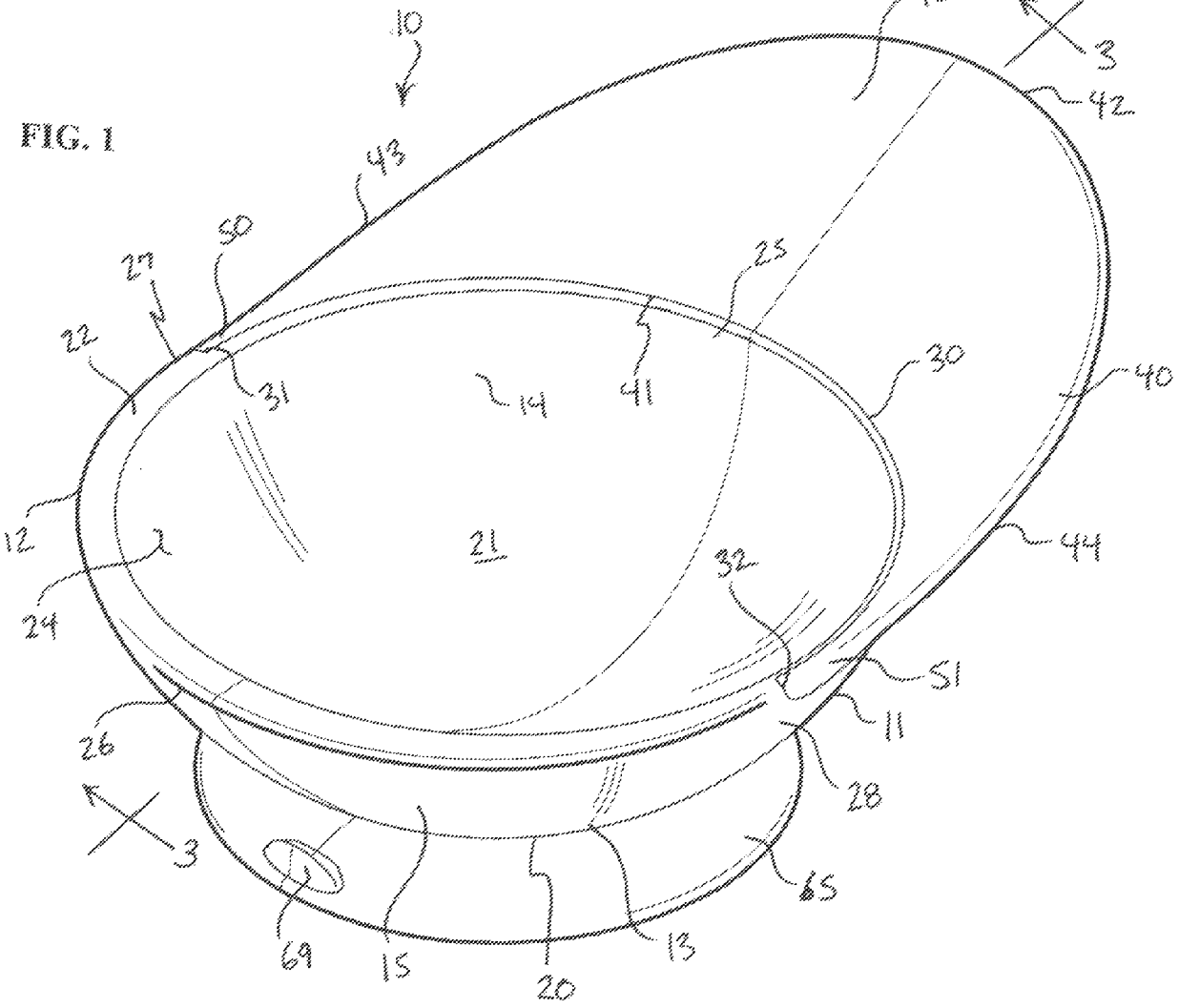
FIG. 1 is a perspective view of a bowl formed with a spill-catching body, the bowl constructed and arranged in accordance with the principle of the invention.

Turning now to the drawings, in which like reference characters indicate corresponding elements throughout the several views, attention is first directed to FIG. 1 in which there is seen a bowl, constructed in accordance with the principle of the present invention and generally designated by the reference character 10. Bowl 10 is specifically constructed and arranged to hold baby food, yogurt, soup, cereal, peas, noodles, or other selected food to be feed to an infant or small child, and includes an upstanding continuous sidewall 11 having opposed upper and lower ends 12 and 13, and, with additional reference to FIG. 3, opposed outer and inner surfaces 14 and 15 extending between opposed upper and lower ends 12 and 13. Referencing FIG. 3, a bottom 20 is formed at lower end 13 of continuous sidewall 11, which cooperates with inner surface 14 of continuous sidewall 11 forming a fluid impervious vessel 21. A continuous peripheral upper edge 22 is formed at upper end 12 of continuous sidewall 11. Peripheral upper edge 22 bounds an opening 24 into vessel 21. Referencing FIGS. 1 and 4, peripheral upper edge 22 defines opposed front and rear ends 25 and 26 thereof, and opposed sides 27 and 28 thereof. Continuous sidewall 11 and bottom 20 forming vessel 21 are formed of substantially rigid material, such metal, wood, hard plastic, earthenware, or the like or a selected combination of rigid materials, and are preferably integrally formed, but may, if desired, be formed from two or more separate pieces affixed together, such as with adhesive, welding, or the like. Vessel 21 formed by the cooperation of inner surface 14 of and bottom 20 is concave in the vertical direction and a horizontal direction.

Figure 3:
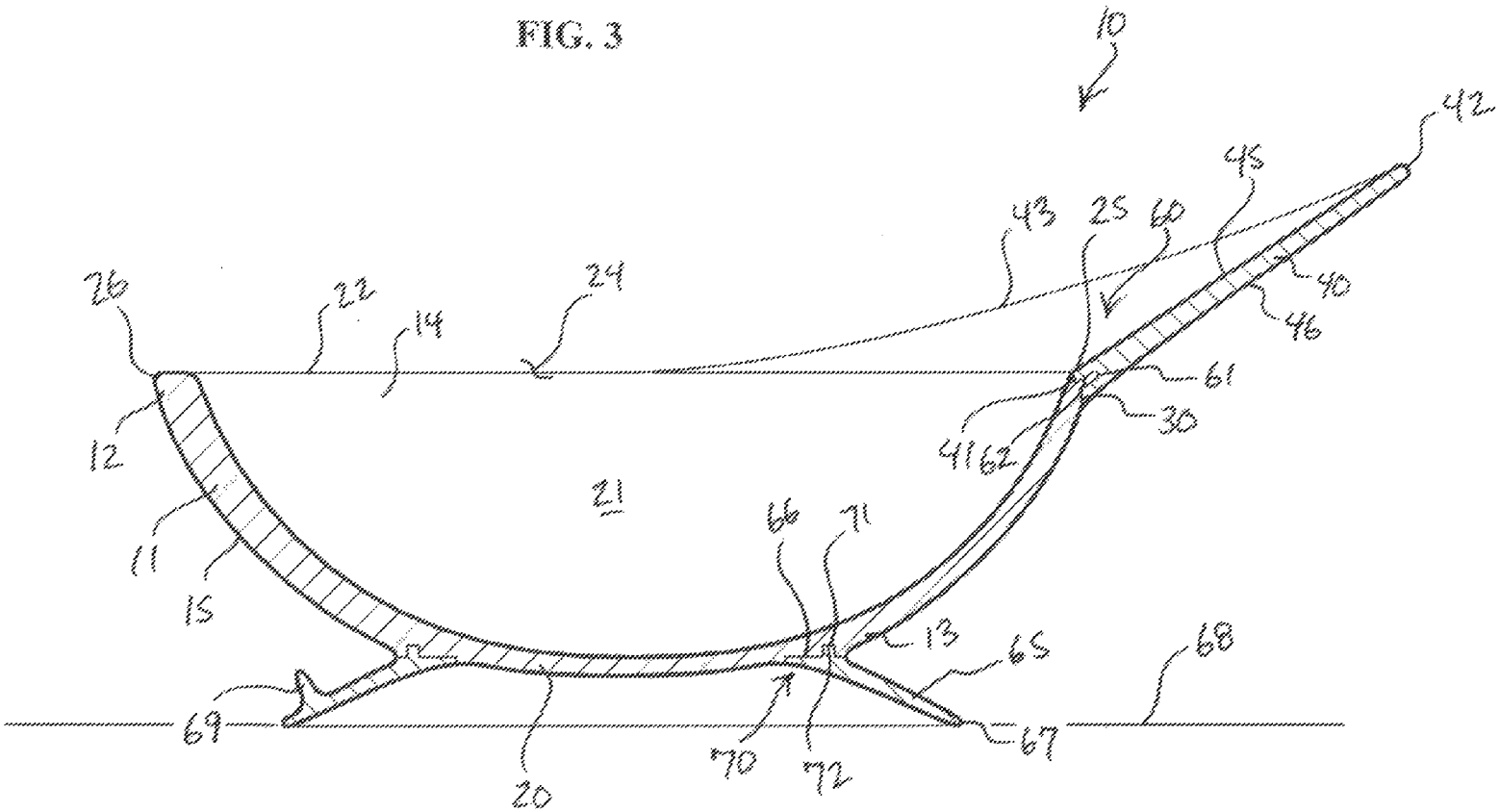
FIG. 3 is a sectional view taken along line 3-3 of FIG. 1.
Figure 4:
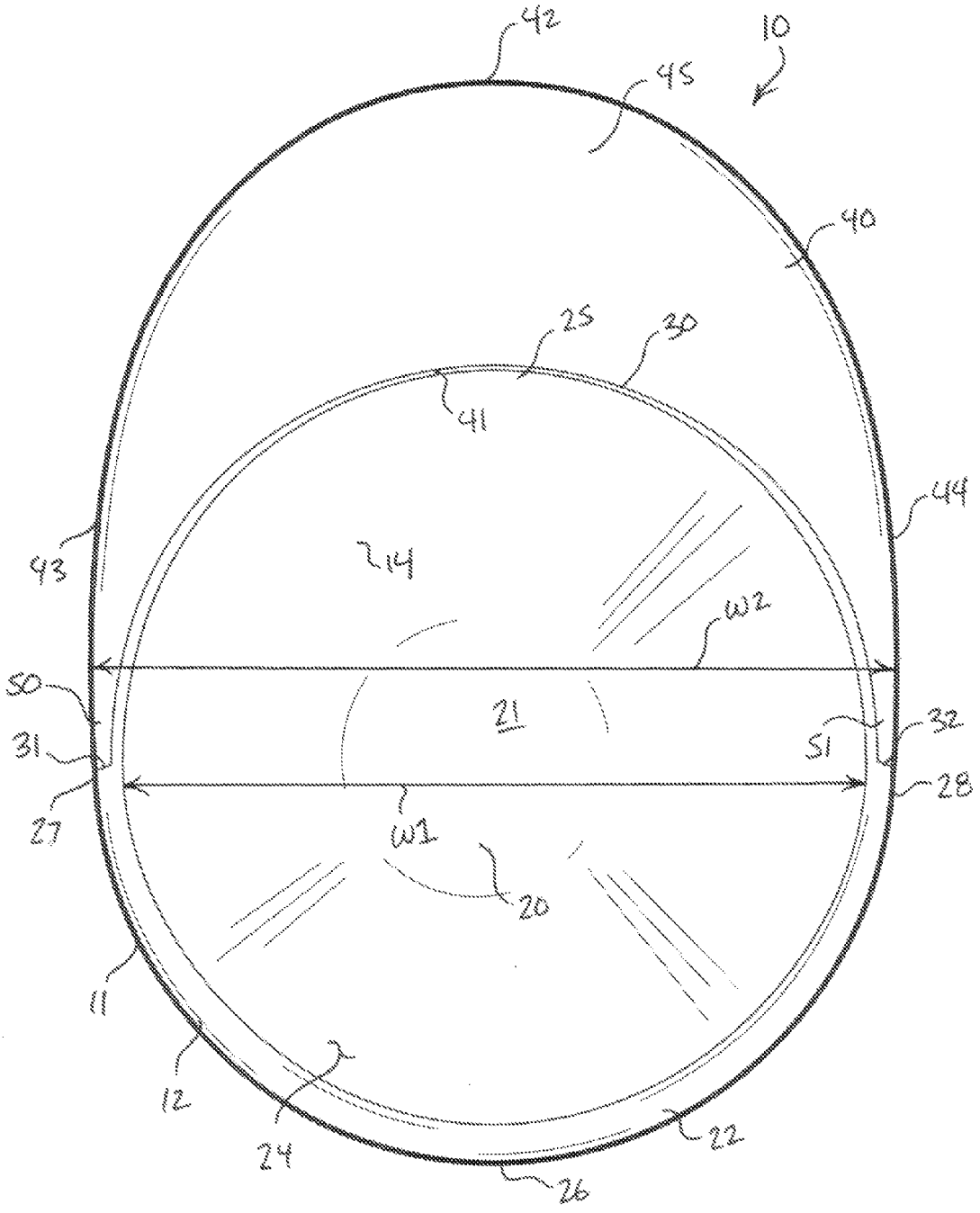
FIG. 4 is a top plan view of the bowl of FIG. 1.

Referring to 1-4, a region of reduced dimension or recess 30 is formed in a length of peripheral upper edge 22 of continuous sidewall 11 extending along front end 25 of peripheral upper edge 22 from, as seen in FIGS. 1 and 4, proximate side 27 of peripheral upper edge 22 to side 28 of peripheral upper edge 22 as clearly seen in FIGS. 1 and 4. Regarding FIGS. 1 and 4, recess 30 extends between opposed endwalls 31 and 32 thereof. Endwall 31 is formed at side 27 of peripheral upper edge 22 at an intermediate location between front end 25 and rear end 26, and endwall 32 is formed at side 28 of peripheral upper edge 22 at an intermediate location between front end 25 and rear end 26. Preferably, endwall 31 is substantially equidistant relative to front and rear ends 25 and 26, and endwall 32 is substantially equidistant relative to front and rear ends 25 and 26. The vertical cross section of recess 30 as illustrated in FIG. 3 is identical along the entire length of recess 30 from endwall 31 to endwall 32 illustrated in FIGS. 1 and 4.

Figure 2:
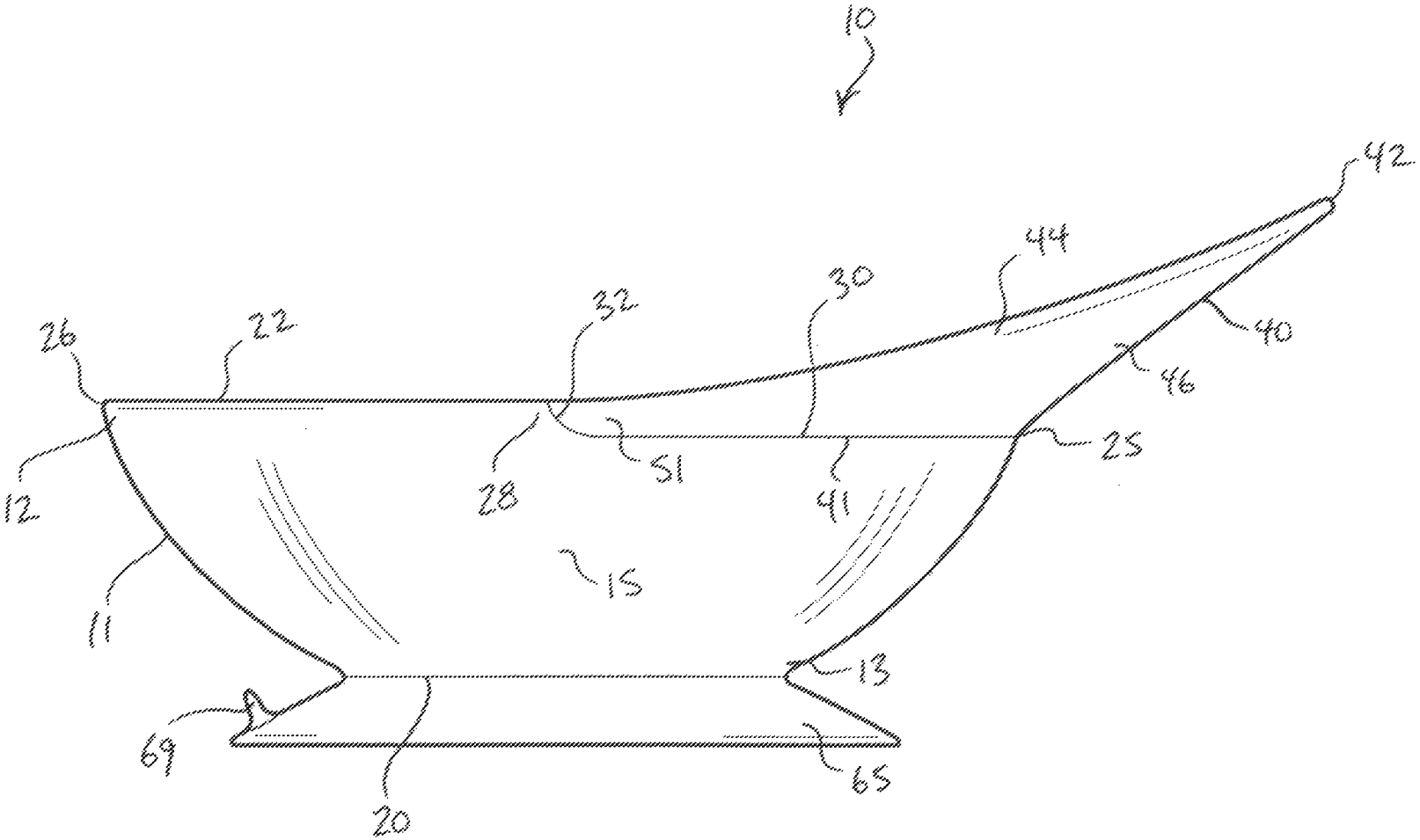
FIG. 2 is a left side elevational view of the bowl of FIG. 1, the opposite right side elevational being the same thereof.
Figure 5:
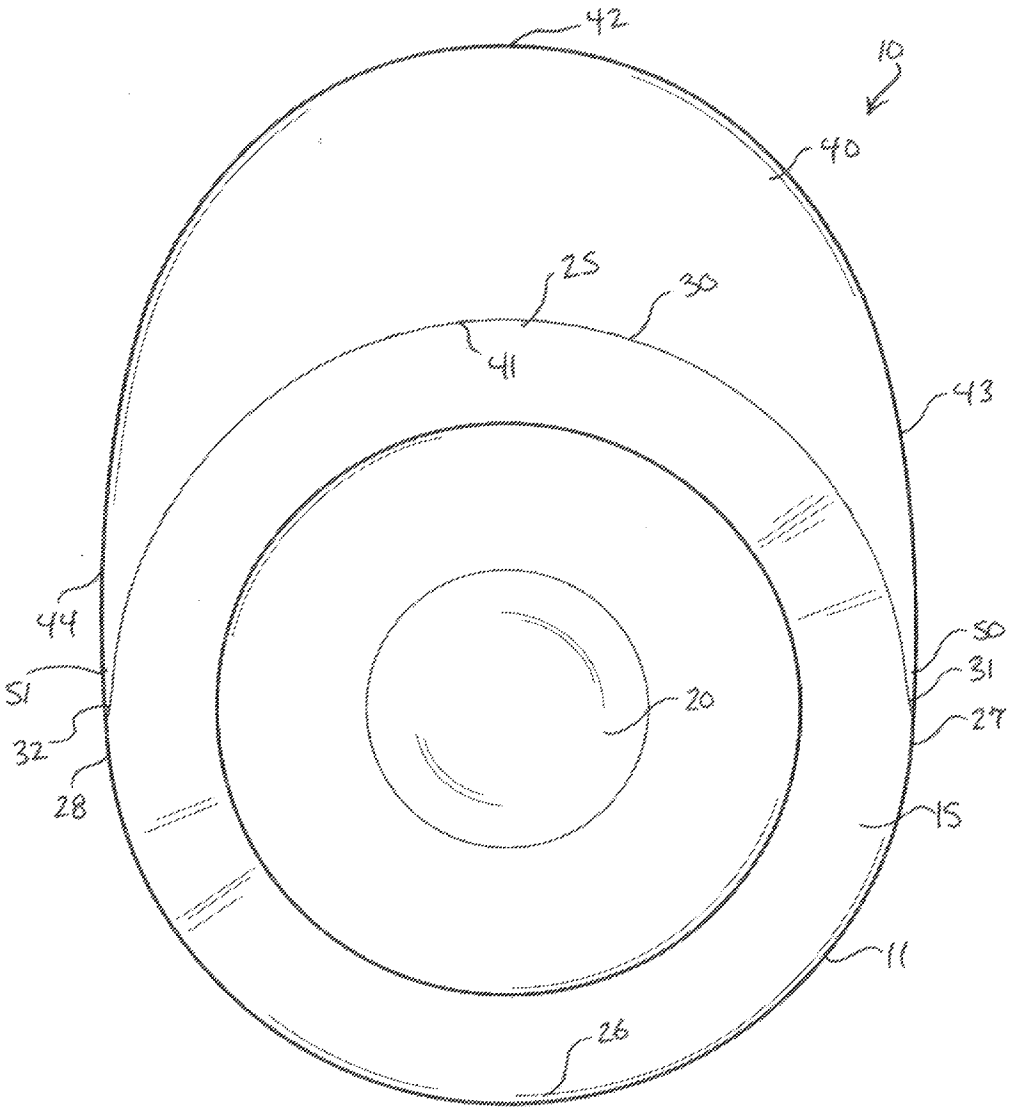
FIG. 5 is a bottom plan view of the bowl of FIG. 1.

As seen in FIGS. 1-4, bowl 10 is formed with a spill-catching body 40, in accordance with the principle of the invention. Spill-catching body 40 is formed of flexibly resilient material, such as rubber or other similar material or combination of materials, is broad in the longitudinal direction as seen in FIGS. 1 and 4 and also in FIG. 5, which is a bottom plan view of bowl 10, and is flat in the vertical direction as illustrated in FIG. 3. Spill-catching body 40, as viewed in FIGS. 1-5, has opposed proximal and distal ends 41 and 42, and, as viewed in FIGS. 1, 4, and 5, has opposed sides 43 and 44. Spill-catching body 40 further includes an upper surface 45 as referenced in FIGS. 1, 3, and 4, and an opposed lower surface 46 as referenced in FIGS. 2, 3, and 5.

Looking to FIG. 4, peripheral upper edge 22 defines a width W1 of opening 24 into vessel 21 of bowl 10 from side 27 of peripheral upper edge 22 of bowl 10 to side 28 of peripheral upper edge 22 of bowl 10, and upper surface 45 constituting the spill-catching surface of spill-catching body 40 proximate proximal end 41 of spill-catching body 40 has a width W2 extending from side 43 of spill-catching body 40 at side 27 of peripheral upper edge 22 to side 44 of spill-catching body 40 at side 28 of peripheral upper edge 22. Width W2 of upper surface 45 at proximal end 41 of spill-catching body 40 is substantially equal to width W1 of opening 24 into vessel 21 extending from side 27 of peripheral upper edge 27 to side 28 of peripheral upper edge, in accordance with the principle of the invention. The width of spill-catching body 40, including the width of upper surface 45, gradually tapers from proximal end 41 of spill-catching body 40 to distal end 42 of spill-catching body 40 extending away from peripheral upper edge 22 of continuous sidewall 11 of bowl 10.

Peripheral upper edge 22 of bowl 10 is generally circular in shape as illustrated in FIG. 4, whereby recess 30 is commensurably outwardly convex. Proximal end 41 of spill-catching body 40 is inwardly concave extending from a finger 50 formed in proximal end 41 at side 43 and an opposed finger 51 formed in proximal end 41 at side 44. The inwardly concave shape and length of proximal end 41 of spill-catching body 40 from finger 50 to finger 51 relates to the outwardly convex shape and length of recess 30 from endwall 31 to endwall 32, and is received in recess 30, whereby finger 50 is received in juxtaposition with endwall 31 and finger 51 is received in juxtaposition with endwall 32, in accordance with the principle of the invention.

Proximal end 41 from finger 50 to finger 51 is affixed to recess 30 formed in peripheral upper edge 22 from endwall 31 at side 27 to endwall 32 at side 28, in which, as viewed in FIGS. 1 and 3, upper surface 45 faces upwardly away from peripheral upper edge 22 of bowl 10 and, as viewed in FIGS. 2 and 3, lower surface 46 faces downwardly toward lower end 13 of bowl 10 away from peripheral upper edge 22. Accordingly, proximal end 41 of spill-catching body 40 is received by and affixed to recess 30 extending along the length of the peripheral upper edge 22 of continuous sidewall 11 of bowl 10 extending along front end 25 of peripheral upper edge 22 from side 27 of peripheral upper edge 22 of continuous sidewall 11 at endwall 31 formed intermediate front and rear ends 25 and 26 to the side 28 of peripheral upper edge 22 of continuous sidewall 11 at endwall 32 formed intermediate front and rear ends 25 and 26.

Figure 6:
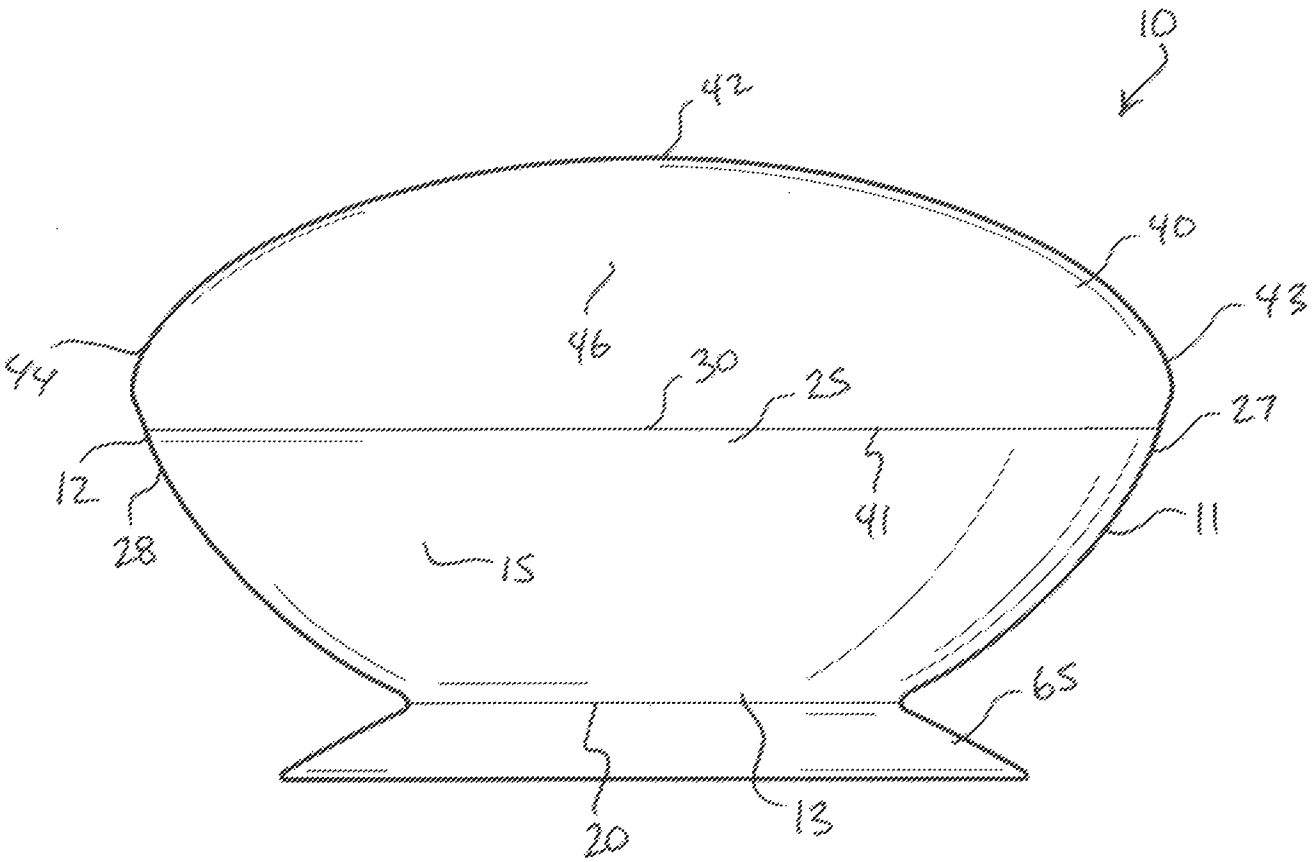
FIG. 6 is a front elevational view of the bowl of FIG. 1.
Figure 7:
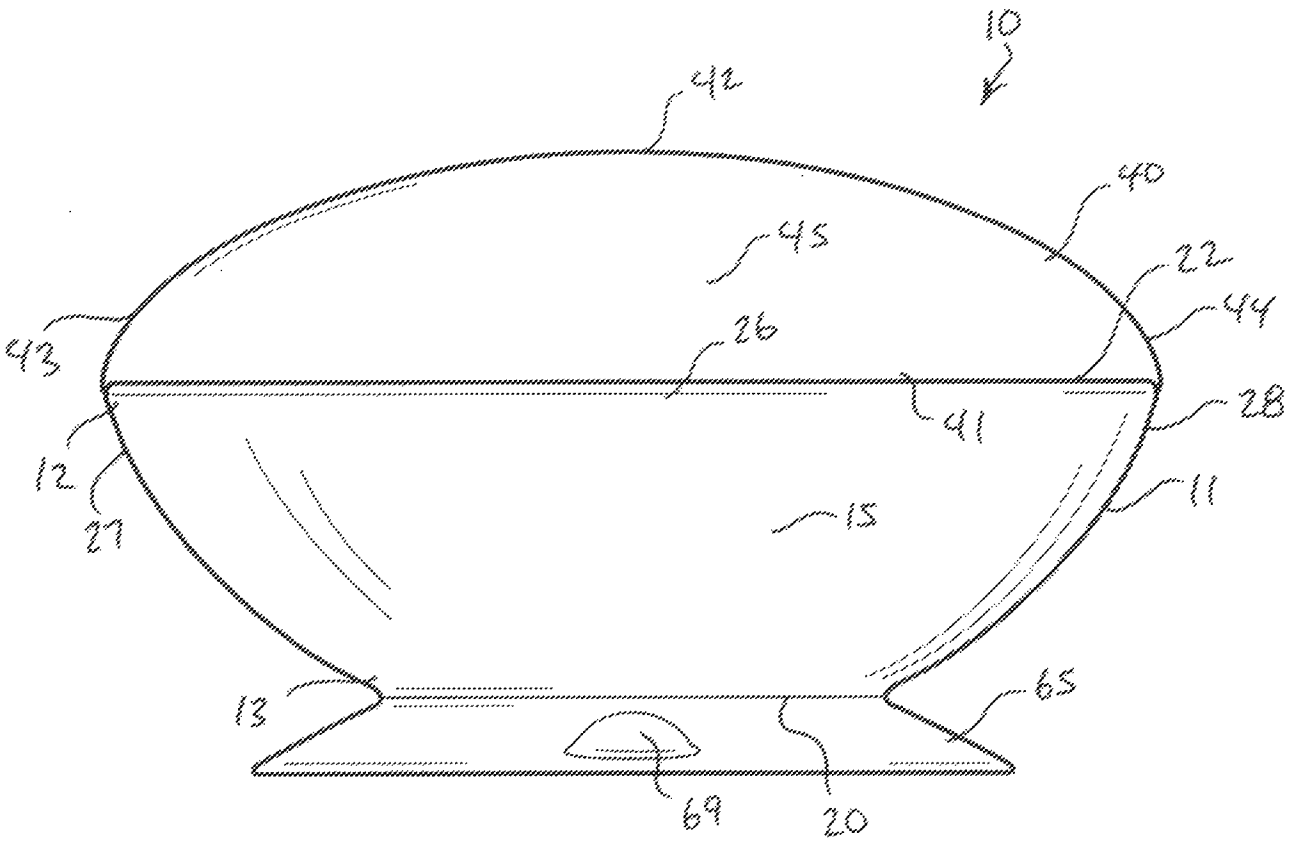
FIG. 7 is a rear elevational view of the bowl of FIG. 1.

As seen in FIGS. 1-3, spill-catching body 40 is up-angled relative to peripheral upper edge 22 of continuous sidewall 11 of bowl 10 and extends outboard relative to front end 25 of peripheral upper edge 22 of continuous sidewall 11 to distal end 42 of spill-catching body 40 from side 27 of peripheral upper edge 22 of continuous sidewall 11 to side 28 of peripheral upper edge 22 of continuous sidewall 11. As a matter of illustration and reference, FIG. 6 is a front elevational view of bowl 10 illustrating spill-catching body 40 projecting upwardly relative to peripheral upper edge 22 of continuous sidewall 11 of bowl 10, and FIG. 7 is a rear elevational view of bowl 10 illustrating spill-catching body 40 projecting upwardly relative to recess 30.

In accordance with the principle of the invention, upper surface 45 is a spill-catching surface formed between proximal and distal ends 41 and 42 of spill-catching body 40, which is up-angled relative to peripheral upper edge 22 of continuous sidewall 11 and extends outboard relative to front end 25 of peripheral upper edge 22 of continuous sidewall 11 of bowl 10 from side 27 of peripheral upper edge 22 of continuous sidewall 11 to side 28 of peripheral upper edge 22 of continuous sidewall 11. Upper surface 45 constitutes the spill-catching surface of spill-catching body 40 of bowl 10, extends between distal end 42 of spill-catching body 40 to proximal end 41 of spill-catching body 40 and meets inner surface 14 of bowl 10 along the entire length of proximal end 41 of spill-catching body 40 from finger 50 to finger 51 as referenced in FIG. 4 in accordance with the principle of the invention. For reference purposes, upper surface 45 extends downwardly toward front end 25 of peripheral upper edge 22 of continuous sidewall 11 from distal end 42 of spill-catching body 40 to proximal end 41 of spill-catching body 40. As seen in FIG. 1, upper surface 45 forming the spill-catching surface of spill-catching body 40 is concave in the vertical direction from side 43 of spill-catching body 40 at side 27 of peripheral upper edge 22 of continuous sidewall 11 to side 44 of spill-catching body 40 at side 28 of peripheral upper edge 22 of continuous sidewall 11, in accordance with the principle of the invention.

Referencing FIG. 3, an element 61 of an engagement pair 60 is formed in recess 30 formed in peripheral upper edge 22 of continuous sidewall 11 that mates with and secures a complemental element 62 of the engagement pair formed in proximal end 41 of spill-catching body 40. Element 61 extends along substantially the entire length of recess 30 from proximate endwall 31 formed at side 27 of peripheral upper edge 22 of continuous sidewall 11 as referenced in FIG. 4, to proximate endwall 32 formed at side 28 of peripheral upper edge 22 of continuous sidewall 11 as referenced in FIG. 4. It is to be understood element 61 formed in recess 30 extends from proximate endwall 31 to endwall 32, and that the vertical cross-sectional shape of element 61 as illustrated in FIG. 3 is identical along the entire length of recess 30 from endwall 31 to endwall 32.

With continuing reference to FIG. 3, a complemental element 62 of engagement pair 60 is formed in proximal end 41 of spill-catching body 40 and extends along substantially the entire length of proximal end 41 from finger 50 to finger 51 as referenced in FIG. 4. It is to be understood that element 62 formed in proximal end 41 extends from finger 50 to finger 51, and that the vertical cross-sectional shape of complemental element 62 as illustrated in FIG. 3 is identical along the entire length of proximal end 41 of spill-catching body 40 from finger 50 at side 43 of spill-catching body 40 to finger 51 at side 44 of spill-catching body 40.

Element 61 of engagement pair 60 is engaged to complemental element 62 of engagement pair 60 securing proximal end 41 of spill-catching body 40 to recess 30. Element 61 of engagement pair 60 relates to complemental element 62 of engagement pair 60, and in this embodiment element 61 of engagement pair 60 consists of a tongue and complemental element 62 of engagement pair 60 consists of a corresponding groove that receives and secures the tongue, although this arrangement can be reversed if desired. A suitable adhesive may be used to affix element 61 to complemental element 62 and also between proximal end 41 of spill-catching body 40 and recess 30 to secure spill-catching body 40 to bowl 10. Alternatively, spill-catching body 40 may be overmolded to bowl 10 forming and overmolding proximal end 41 relative to recess 30 and element 61 of engagement pair 60 forming complemental element 62 in the overmolding process. Those having regard for the art will readily appreciate that although element 61 of engagement pair 60 is a tongue and complemental element 62 of engagement pair 60 is a groove, any suitable form of complementing engagement pair can be used between proximal end 41 of spill-catching body 40 of recess 30 without departing from the invention.

Bowl 10 is intended to be used by an infant or small child in eating cereal, soup, applesauce, peas, noodles, or other selected food placed in vessel 21 (FIGS. 3 and 4), such as with the use of a spoon of fork or other selected eating utensil, and is fashioned with a mechanism for allowing bottom 20 of bowl 10 to be removably affixed to a table or tray or other selected surface for preventing the infant or small child from tipping bowl 10 over spilling the contents of vessel 21. Referencing FIG. 3, the preferred mechanism used to releasably secure bottom 20 of bowl 10 to a selected surface includes a suction cup 65 affixed to bottom 20 of bowl 10. Suction cup 65 includes an upper end 66 affixed to bottom 20 of bowl 10 and an opposed lower end 67 for application of suction cup 65 to a selected surface 68, which may be the surface of a table or tray as a matter of example.

Referencing FIG. 3, an element 71 of an engagement pair 70 is formed in upper end 66 of suction cup 65 that mates with and secures a complemental element 72 of the engagement pair 70 formed in bottom 20 of bowl 10. In the present embodiment, element 71 of engagement pair 70 is engaged to complemental element 72 of engagement pair 70 securing upper end 66 of suction cup 65 to bottom 20 of bowl 10.

Element 71 of engagement pair 70 relates to complemental element 72 of engagement pair 70, and in this embodiment element 71 of engagement pair 70 consists of an annular tongue and complemental element 72 of engagement pair 70 consists of a corresponding annular groove that receives and secures the annular tongue, although this arrangement can be reversed if desired. A suitable adhesive may be used to affix element 71 to complemental element 72 and also between upper end 66 of suction cup 65 and bottom 20 to secure suction cup 65 to bottom 20 of bowl 10. Alternatively, suction cup 65 may be overmolded to bottom 20 of bowl 10 forming and overmolding upper end 66 relative to bottom 20 and complemental element 72 of engagement pair 70 forming element 71 in the overmolding process. Those having regard for the art will readily appreciate that although element 71 of engagement pair 70 is a tongue and complemental element 72 of engagement pair 70 is a groove, any suitable form of complementing engagement pair can be used between upper end 66 of suction cup 65 and bottom 22 without departing from the invention.

Figure 8:
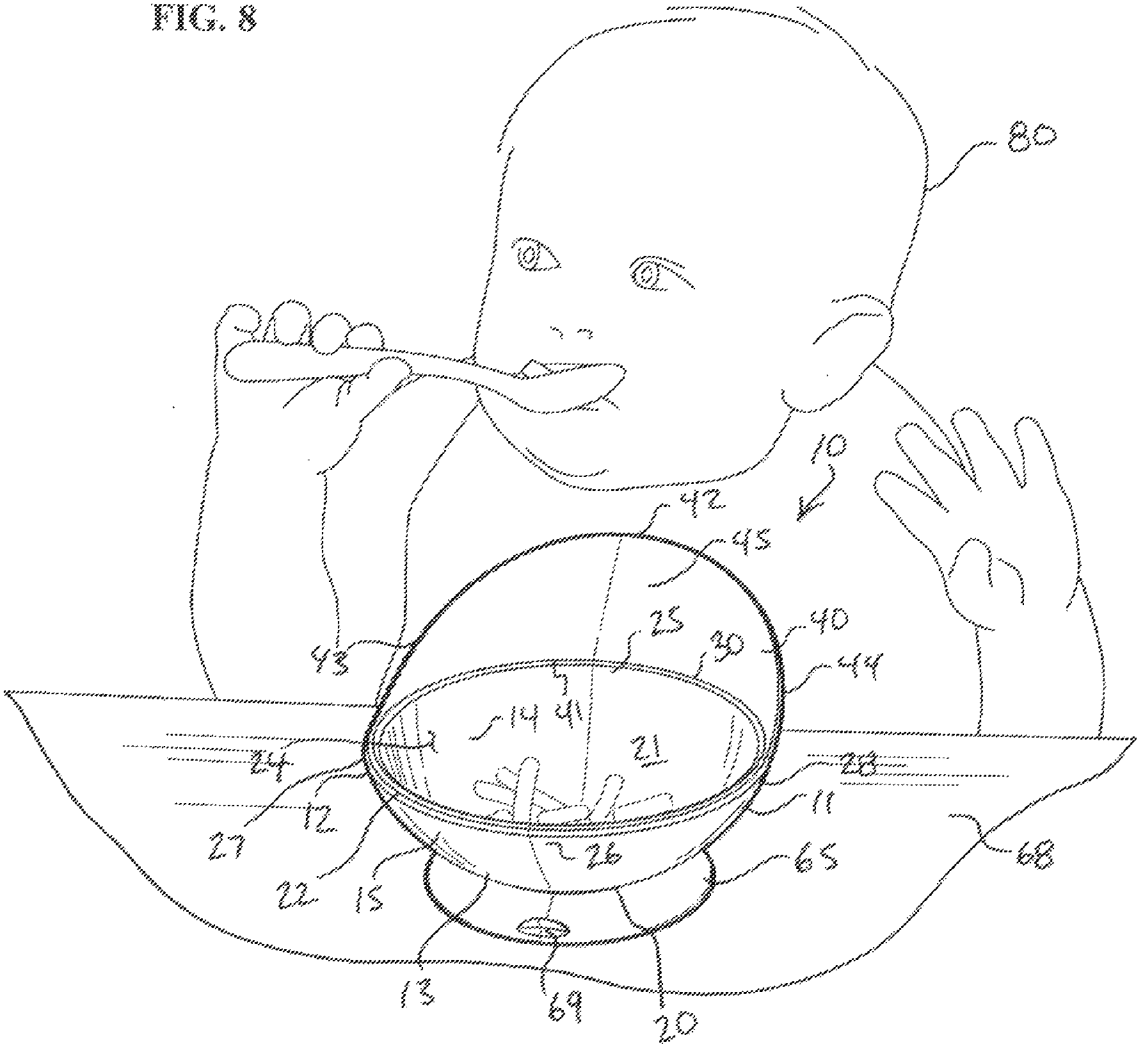
FIG. 8 is a perspective view of a child eating food from the bowl of FIG. 1 positioned on a support surface in front of the child.

In use as illustrated in FIG. 8, bowl 10 is taken up, such as by hand, bottom 20 of bowl 10 is directed toward surface 68 (also referenced in FIG. 3), which may be the surface of a tray or a table or other selected surface, and lower end 67 of suction cup 65 is directed against surface 68, in which bowl 10 extends upwardly relative to surface 68 from bottom 20 at lower end 13 of bowl 10 to peripheral upper edge 22 of continuous sidewall 11 at upper end 12 of bowl 10. Through the application of downward pressure exerted against bowl 10 toward surface 68, suction cup 65 suctionally secures surface 68 releasably securing bowl 10 to surface 68. A child 80 to be fed is seated in front of bowl 10 opposing front end 25 of peripheral upper edge 22 of continuous sidewall 11 of bowl 10, in which spill-catching body 40 is directed toward child 80 underneath his child's face. Food, such as cereal, baby food, applesauce, soup, yogurt, noodles, peas, or other selected food, is placed into vessel 21 through opening 24. As child 80 eats food from vessel 21, either by being feed by a caregiver or through self-feeding, such as with the use of a spoon or fork, food spilled from child's 80 mouth falls downwardly onto upper surface 45 forming the spill-catching surface of bowl 10.

Because upper surface 45 is angled downwardly relative to opening 24 into vessel 21 from distal end 42 of spill-catching body 40 to proximal end 41 of spill-catching body 40, spilled food that falls onto upper surface 45 is directed downwardly toward front end 25 of peripheral upper edge 22 of continuous sidewall 11 of bowl 10 and back into vessel 21 through opening 24, in accordance with the principle of the invention. Because upper surface 45 forming the spill-catching surface of spill-catching body 40 is concave in the vertical direction from side 43 of spill-catching body 40 at side 27 of peripheral upper edge 22 of continuous sidewall 11 to side 44 of spill-catching body 40 at side 28 of peripheral upper edge 22 of continuous sidewall 11, food spilled onto upper surface 45 is funneled into vessel 21 through opening 24, in accordance with the principle of the invention. Furthermore, because width W2 of upper surface 45 at proximal end 41 of spill-catching body 40 is substantially equal to width W1 of opening 24 into vessel 21 extending from side 27 of peripheral upper edge 27 to side 28 of peripheral upper edge, food spilled onto upper surface 45 is prevented from spilling outwardly relative to sides 43 and 44 of spill-catching body 40 at proximal end 41 of spill-catching body 40 at peripheral upper edge 22 of continuous sidewall 11 of bowl 10, and also sides 27 and 28 of peripheral upper edge 22 of continuous sidewall 11 of bowl 10 at proximal end 41 of spill-catching body 40, in accordance with the principle of the invention. The flexibly resilient characteristic of spill-catching body 40 allows spill-catching body 40 to yield and deflect thereby preventing child 80 from hurting himself in the event child 80 inadvertently hits his face or mouth against spill-catching body 40 directed toward child 80.

After use of bowl 10 is complete, suction cup 65 may be released from surface 68 detaching bowl 10 from surface 68, and then bowl 10 may be cleaned and dried, whether by hand or with the use of a dishwasher, and subsequently stored, such as in a cupboard. As seen in FIGS. 1-3, 7, and 8, suction cup 65 is formed with an outwardly projecting tab 69, which may be taken up by hand and used to pry suction cup 65 away from surface 68 to release the suction grip of suction cup 65 relative to surface 68.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A bowl, comprising:

an upstanding continuous sidewall having opposed upper and lower ends, opposed outer and inner surfaces extending between the opposed upper and lower ends, a bottom formed at the lower end of the continuous sidewall cooperating with the inner surface of the continuous sidewall forming a vessel, and a peripheral upper edge formed at the upper end of the continuous sidewall bounding an opening into the vessel, the peripheral upper edge defining opposed front and rear ends, and opposed first and second sides;

a recess formed in a length of the peripheral upper edge of the continuous sidewall extending along the front end of the peripheral upper edge of the continuous sidewall from proximate the first side of the peripheral upper edge of the continuous sidewall to the second side of the peripheral upper edge of the continuous sidewall;

a broad spill-catching body having opposed proximal and distal ends, the proximal end of the spill-catching body received by and affixed to the recess extending along the length of the peripheral upper edge of the continuous sidewall extending along the front end of the peripheral upper edge from proximate the first side of the peripheral upper edge of the continuous sidewall to the proximate second side of the peripheral upper edge of the continuous sidewall;

the spill-catching body up-angled and extending outboard relative to the front end of the peripheral upper edge of the continuous sidewall to the distal end of the spill-catching body from proximate the first side of the peripheral upper edge of the continuous sidewall to proximate the second side of the peripheral upper edge of the continuous sidewall;

the spill-catching body defining an upwardly facing spill-catching surface between the proximal and distal ends of the spill-catching body, the spill-catching surface up-angled and extending outboard relative to the front end of the peripheral upper edge of the continuous sidewall from proximate the first side of the peripheral upper edge of the continuous sidewall to proximate the second side of the peripheral upper edge of the continuous sidewall, the spill-catching surface abuts the inner surface of the continuous sidewall and is for receiving spilled food outboard of the peripheral upper edge and conducting spilled food into the vessel through the opening;

the continuous sidewall is formed of a rigid material; and the spill-catching body is formed of a flexibly resilient rubber that can yield and deflect in response to being hit to prevent hurt to a child who accidentally hits the spill-catching body with his face or mouth.

2. The bowl according to claim 1, further comprising an element of an engagement pair formed in the recess formed in the peripheral upper edge of the continuous sidewall from proximate the first side of the peripheral upper edge of the continuous sidewall to proximate the second side of the peripheral upper edge of the continuous sidewall secured to a complemental element of the engagement pair formed in the proximal end of the spill-catching body.

3. The bowl according to claim 2, wherein the element of the engagement pair includes one of a tongue and groove, and the complemental element of the engagement pair includes the other of the tongue and the groove.

4. The bowl according to claim 1, further comprising means for releasably securing the bottom of the bowl to a selected surface.

5. The bowl according to claim 4, wherein the means for releasably securing the bottom of the bowl to the selected surface comprises a suction cup affixed to the bottom of the bowl.

6. The bowl according to claim 5, further comprising an element of an engagement pair formed in the bottom of the bowl secured to a complemental element of the engagement pair formed in the suction cup securing the suction cup to the bottom of the bowl.

7. The bowl according to claim 6, wherein the element of the engagement pair formed in the bottom of the bowl includes one of a tongue and groove, and the complemental element of the engagement pair formed in the suction cup includes the other of the tongue and the groove.

8. The bowl according to claim 1, wherein the spill-catching surface is concave in a vertical direction from proximate the first side of the peripheral upper edge of the continuous sidewall to the second side of the peripheral upper edge of the continuous sidewall.

9. The bowl according to claim 1, further comprising:

the opening into the vessel having a first width extending from the first side of the peripheral upper edge of the continuous sidewall to the second side of the peripheral edge of the continuous sidewall;

the spill-catching surface of the spill-catching body proximate the proximal end of the spill-catching body having a second width extending from proximate the first side of the peripheral upper edge of the continuous sidewall to the second side of the peripheral upper edge of the continuous sidewall; and the second width equal to the first width.

* * * * *